US007594945B2

(12) United States Patent
Kim et al.

(10) Patent No.: US 7,594,945 B2
(45) Date of Patent: Sep. 29, 2009

(54) DUST RECEPTACLE FIXING/SEPARATING APPARATUS AND A CYCLONE DUST COLLECTING DEVICE HAVING THE SAME

(75) Inventors: Dong-jun Kim, Gwangju (KR); Kyoung-woung Kim, Gwangju (KR)

(73) Assignee: Samsung Gwangju Electronics Co., Ltd., Gwangju (KR)

( * ) Notice: Subject to any disclaimer, the term of this patent is extended or adjusted under 35 U.S.C. 154(b) by 566 days.

(21) Appl. No.: 11/317,549

(22) Filed: Dec. 23, 2005

(65) Prior Publication Data

US 2006/0272300 A1 Dec. 7, 2006

(30) Foreign Application Priority Data

Jun. 1, 2005 (KR) ..... 10-2005-0046824

(51) Int. Cl.
*B01D 45/12* (2006.01)

(52) U.S. Cl. ..... 55/429; 55/459.1; 55/DIG. 3

(58) Field of Classification Search ..... 55/429, 55/459.1, DIG. 3
See application file for complete search history.

(56) References Cited

U.S. PATENT DOCUMENTS

| | | | | |
|---|---|---|---|---|
| 2001/0054213 | A1 | 12/2001 | Oh et al. | 15/353 |
| 2003/0226228 | A1 | 12/2003 | Symensma et al. | 15/200 |
| 2004/0098827 | A1 | 5/2004 | Oh et al. | 15/347 |
| 2004/0205926 | A1 | 10/2004 | Fawcett | 15/326 |
| 2004/0205928 | A1 | 10/2004 | Alford et al. | 15/352 |

FOREIGN PATENT DOCUMENTS

| | | | |
|---|---|---|---|
| CH | 688734 | A5 | 2/1998 |
| EP | 956806 | A1 * | 11/1999 |
| KR | 1020000007813 | | 2/2000 |

OTHER PUBLICATIONS

Offical Action dated Apr. 18, 2007 from corresponding Russian Patent Application No. 2006102976.
Extended European Search Report dated Oct. 16, 2006 issued from the European Patent Office with respect to European Patent Application No. 06290140.0 filed on Jan. 20, 2006.

* cited by examiner

*Primary Examiner*—Robert A Hopkins
(74) *Attorney, Agent, or Firm*—Ohlandt, Greeley, Ruggiero & Perle, L.L.P.

(57) ABSTRACT

Disclosed are a dust receptacle fixing/separating apparatus that fixes and separates a dust receptacle with respect to a cyclone unit, and a cyclone dust collecting device having the same. The dust receptacle fixing/separating apparatus comprises a fixing/separating handle, a locking/unlocking part, and a fixing part. The fixing/separating handle pivots between a first position and a second position, the first position in which the cyclone unit and the dust receptacle are fixed to each other and the second position in which the cyclone unit and the dust receptacle can be separated from each other. The locking/unlocking part fixes and releases the fixing/separating handle when the fixing/separating handle is in the first position. The fixing part pivotably mounting the fixing/separating handle releases connection between the cyclone unit and the dust receptacle when the fixing/separating handle is in the second position.

10 Claims, 6 Drawing Sheets

DUST RECEPTACLE FIXING/SEPARATING APPARATUS AND A CYCLONE DUST COLLECTING DEVICE HAVING THE SAME

CROSS-REFERENCE TO RELATED APPLICATIONS

This application claims benefit under 35 U.S.C. § 119(a) of Korean Patent Application No. 2005-46824, filed Jun. 1, 2005, the entire contents of which are incorporated herein by reference.

BACKGROUND OF THE INVENTION

1. Field of the Invention

The present invention relates to a vacuum cleaner. More particularly, the present invention relates to a dust receptacle fixing/separating apparatus for fixing and separating a dust receptacle with respect to a cyclone unit applied for a vacuum cleaner to centrifugally separate and collect dust from external air as drawn in, and a cyclone dust collecting device having the same.

2. Description of the Related Art

A cyclone dust collecting device is used for a vacuum cleaner to separate and collect dust from drawn-in air and for this purpose, comprises a cyclone unit that separates the dust from the external air by a centrifugal force and a dust receptacle that collects therein the separated dust.

FIG. 1 shows a generally upright-type vacuum cleaner adopting the cyclone dust collecting device. The vacuum cleaner 10 comprises a cleaner body 20 including a motor driving chamber 21 and a dust collecting chamber 22, a suction brush 30 that draws in dust on a surface being cleaned together with ambient air, and a cyclone dust collecting device 40. The cyclone dust collecting device 40 comprises a cyclone unit 50 and a dust receptacle 60 and is mounted detachably to the dust collecting chamber 22 of the cleaner body 20, with the cyclone unit 50 and the dust receptacle 60 connected with each other. The dust receptacle 60 has a handle 61 for convenient mounting and separation of the cyclone dust collecting device 40 with respect to the cleaner body 20.

As shown in FIG. 1, the cyclone dust collecting device 40 is mounted to the cleaner body 20 in a manner that an air inlet 51 and an air outlet 52 of the cyclone unit 50 are respectively connected to an air suction path 23 and an air discharge path 24 of the cleaner body 20. Upon starting the vacuum cleaner 10, a motor (not shown) in the motor driving chamber 21 generates a suction force at the suction brush 30. Dust-laden air on the surface being cleaned is drawn by a centrifugal force into the cyclone unit 50, passing through the suction brush 30, the air suction path 23, and the air inlet 51. The air being drawn in is induced spirally along an inner circumference of the cyclone unit 50 by the air inlet 51, thereby generating an air-vortex. The dust included in the air is separated by the centrifugal force of the air-vortex and collected in the dust receptacle 60. The dust-separated air is discharged to the outside, passing through a grill 70, the air outlet 52, the air discharge path 24, and the motor driving chamber 21.

When the dust receptacle 60 is filled with the dust by a predetermined amount after the cleaning work, a user separates the cyclone dust collecting device 40 from the cleaner body 20 by grasping the handle 61 to empty the dust receptacle 60. More specifically, here, the dust receptacle 60 needs to be separated from the cyclone unit 50.

However, while separating the cyclone dust collecting device 40 from the cleaner body 20 or carrying the cyclone dust collecting device 40 to empty the dust receptacle 60, connection between the dust receptacle 60 and the cyclone unit 50 might be released unintentionally. In this case, the dust in the dust receptacle 60 may be scattered about, thereby contaminating the surroundings.

In order to tighten the connection between the dust receptacle 60 and the cyclone unit 50, screw-connection of the dust receptacle 60 and the cyclone unit 50 has been suggested. However, the screw-connection is inconvenient for the user because the user has to hold one of the dust receptacle 60 and the cyclone unit 50 with one hand while unfastening a screw with the other hand. Furthermore, the dust receptacle 60 and the cyclone unit 50 are not easy to grasp with one hand.

SUMMARY OF THE INVENTION

An aspect of the present invention is to solve at least the above problems and/or disadvantages and to provide at least the advantages described below. Accordingly, an aspect of the present invention is to provide a dust receptacle fixing/separating apparatus facilitating separation of a dust receptacle from a cyclone unit and enhancing connection between the dust receptacle and the cyclone unit, and a cyclone dust collecting device having the same.

In order to achieve the above-described aspects of the present invention, there is provided a dust receptacle fixing/separating apparatus that fixes and separates a dust receptacle with respect to a cyclone unit. The dust receptacle fixing/separating apparatus comprises a fixing/separating handle, a locking/unlocking part, and a fixing part. The fixing/separating handle pivots between a first position and a second position, the first position in which the cyclone unit and the dust receptacle are fixed to each other and the second position in which the cyclone unit and the dust receptacle can be separated from each other. The locking/unlocking part fixes and releases the fixing/separating handle when the fixing/separating handle is in the first position. The fixing part to which the fixing/separating handle is pivotably connected, releases connection between the cyclone unit and the dust receptacle when the fixing/separating handle is in the second position.

The fixing/separating handle comprises a handle part having a locking groove for engagement with a locking projection formed at the locking/unlocking part; and a hinge connection part formed on opposite ends of the handle part and engaged with a hinge shaft of the fixing part.

The locking/unlocking part comprises a button including the locking projection; and a resilient member connected to the button by one end to resiliently bias the button in one direction.

The locking/unlocking part is provided to a receptacle handle formed on the dust receptacle.

The fixing part includes a first projection formed in adjacent to the hinge shaft, and the hinge connection part comprises an outer frame pivoting in contact with the first projection by an inner circumference thereof and having a separation opening at a predetermined portion, and a hinge connection groove formed at the center of the outer frame and engaged with the hinge shaft, the separation opening being located to correspond to the first projection as the fixing/separating handle is in the second position.

The hinge shaft is mounted to the cyclone unit while the first projection is mounted to the dust receptacle.

The fixing part further comprises a second projection mounted to the dust receptacle to be located within the outer frame, and the hinge connection part further comprises a fixing rib mounted inside the outer frame, the fixing rib contacting with the second projection as the fixing/separating handle is moved to the second position, thereby restraining the fixing/separating handle from pivoting any more in a direction to the second position.

The first position and the second position are substantially perpendicular to each other.

According to another aspect of the present invention, there is provided a cyclone dust collecting device including a dust receptacle having a receptacle handle and opened upward, and a cyclone unit removably connected to the dust receptacle and centrifugally separating dust from external air, the cyclone dust collecting device comprising a fixing/separating handle pivoting between a first position and a second position, the first position in which the cyclone unit and the dust receptacle are fixed to each other and the second position in which the cyclone unit and the dust receptacle can be separated from each other; a locking/unlocking part mounted to the receptacle handle to fix and release the fixing/separating handle when the fixing/separating handle is in the first position; and a fixing part to which the fixing/separating handle is pivotably connected, releasing connection between the cyclone unit and the dust receptacle when the fixing/separating handle is in the second position.

BRIEF DESCRIPTION OF THE DRAWING FIGURES

The above aspect and other features of the present invention will become more apparent by describing in detail exemplary embodiments thereof with reference to the attached drawing figures, wherein.

DETAILED DESCRIPTION OF THE EXEMPLARY EMBODIMENTS

Figure 1:
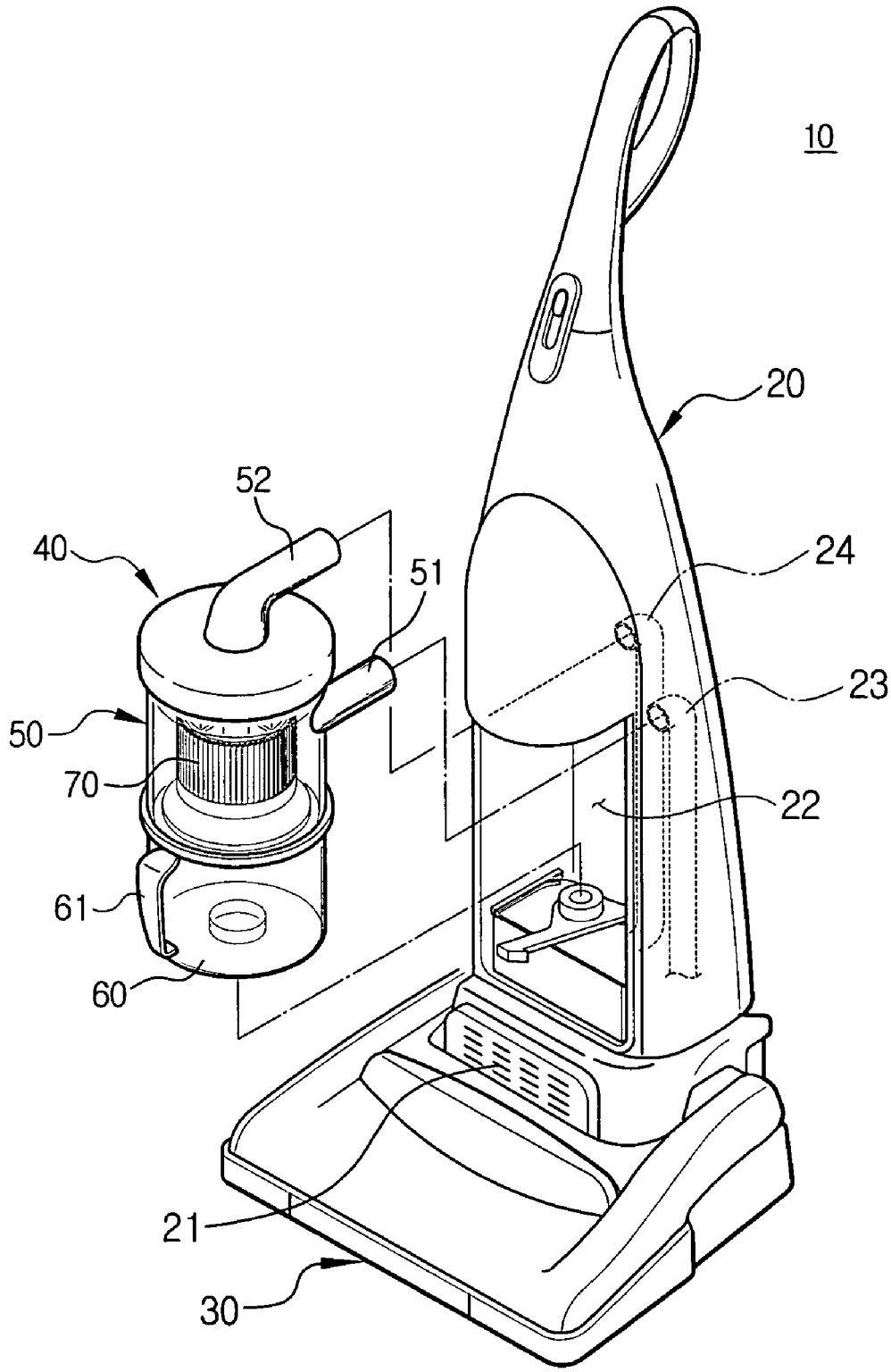
FIG. 1 (PRIOR ART)
FIG. 1 is a perspective view of a vacuum cleaner adopting a conventional cyclone dust collecting device.

Hereinafter, a dust receptacle fixing/separating apparatus and a cyclone dust collecting device having the same according to an embodiment of the present invention will be described in detail with reference to the accompanying drawing figures.

In the following description, same drawing reference numerals are used for the same elements even in different drawings. The matters defined in the description such as a detailed construction and elements are nothing but the ones provided to assist in a comprehensive understanding of the invention. Thus, it is apparent that the present invention can be carried out without those defined matters. Also, well-known functions or constructions are not described in detail since they would obscure the invention in unnecessary detail.

Figure 2A:
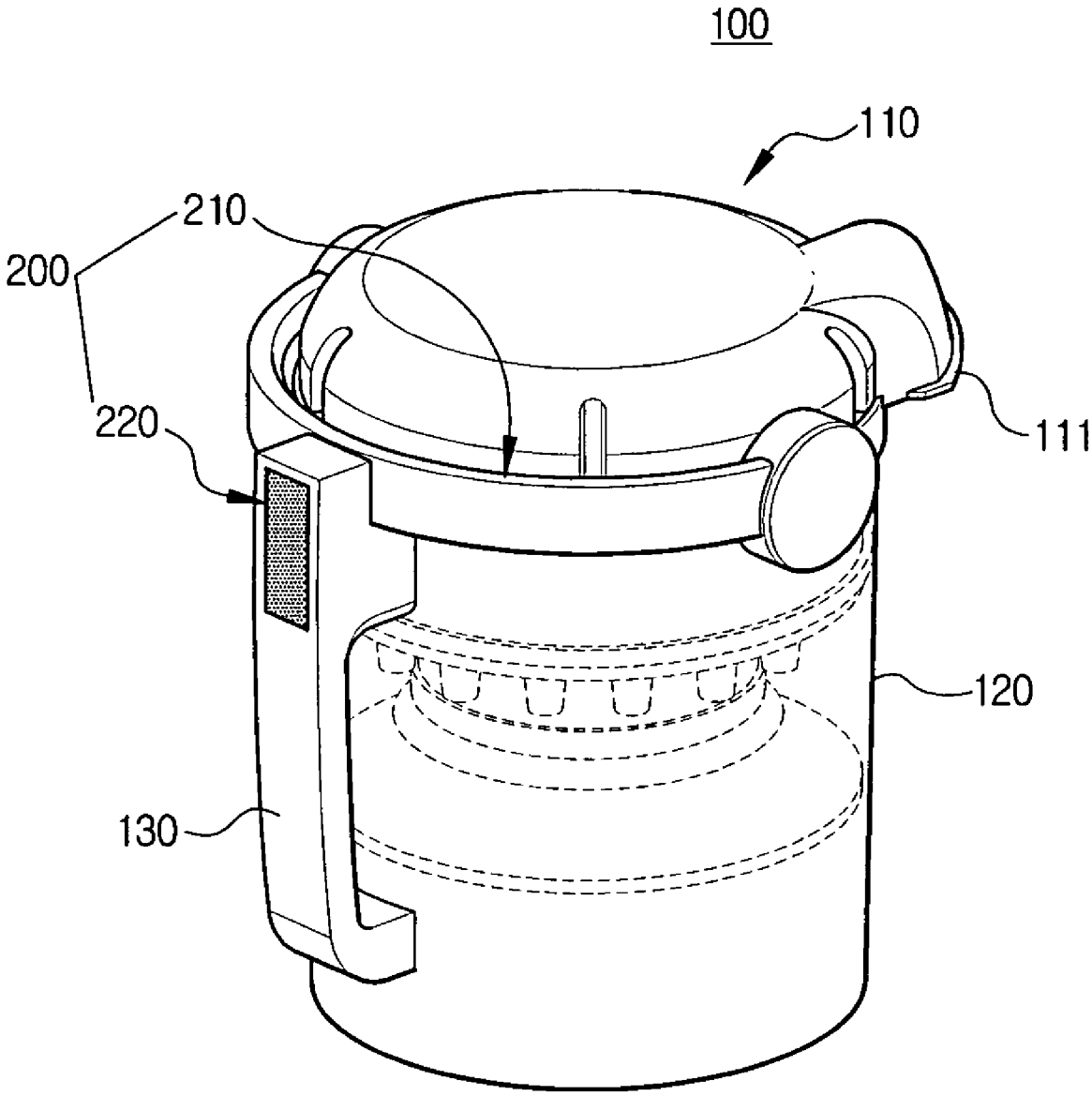
FIG. 2A is a perspective view of a cyclone dust collecting device adopting a dust receptacle fixing/separating apparatus according to an embodiment of the present invention.
Figure 2B:
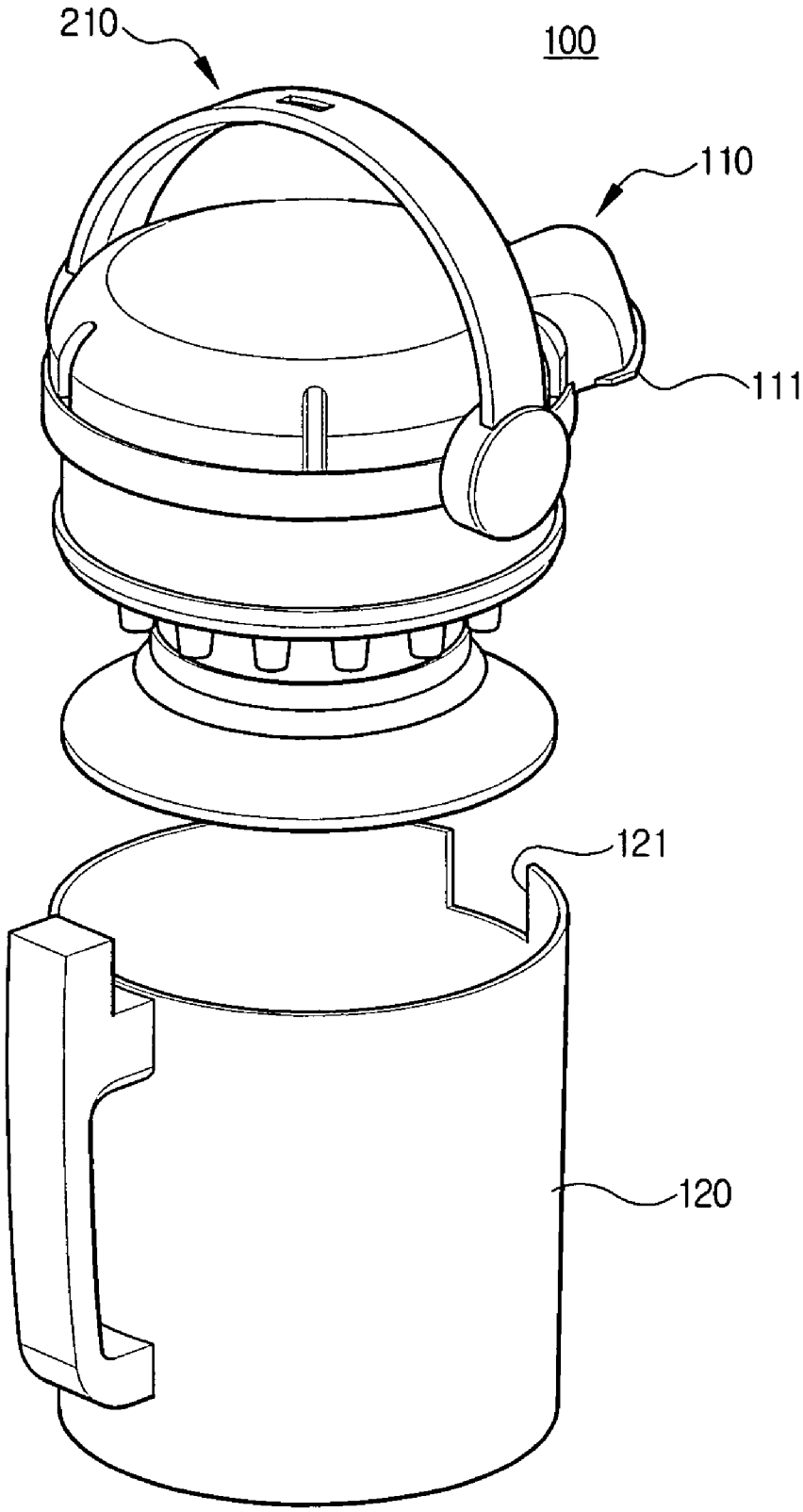
FIG. 2B is a perspective view showing a cyclone unit and a dust receptacle of FIG. 2A, as separated from each other.

Referring to FIGS. 2A and 2B, a cyclone dust collecting device 100 comprises a cyclone unit 110 for centrifugally separating dust from drawn-in air, a dust receptacle 120 collecting therein the dust separated by the cyclone unit 110, and a dust receptacle fixing/separating apparatus 200. The cyclone unit 100 is detachably connected to the dust receptacle 120, by insertion into the dust receptacle 120. The cyclone unit 110 comprises an air inlet (not shown) and an air outlet 111 connected to an opening 121 of the dust receptacle 120. The dust included in the air drawn in through the air inlet is separated from the drawn-in air by the cyclone unit 110. The separated dust is collected in the dust receptacle 120, whereas the dust-separated air is discharged to the outside of the cyclone dust collecting device 100 through the air outlet 111. The dust receptacle 120 has a receptacle handle 130 for use during mounting and separation of the cyclone dust collecting device 100 with respect to a cleaner body 20 (FIG. 1). Since the operation principles and the structure of the cyclone dust collecting device 100 are not the essential feature of the present invention, they will not described herein in detail.

Figure 5:
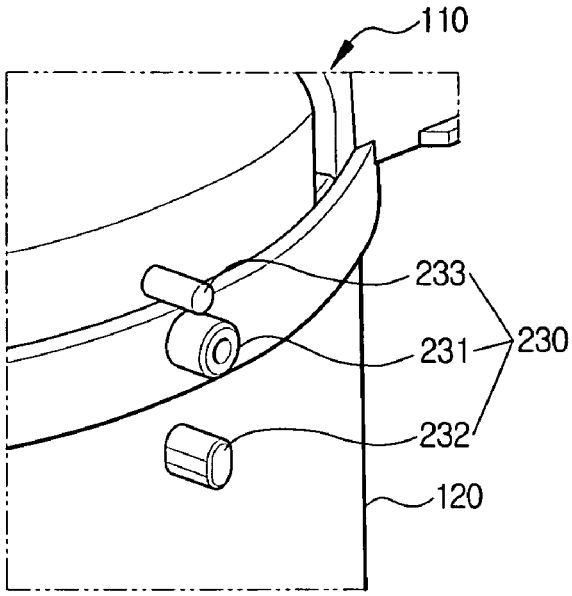
FIG. 5 is a perspective view of a fixing part of the dust receptacle fixing/separating apparatus of FIG. 2A.

A dust receptacle fixing/separating apparatus 200 provides a fixed connection between the cyclone unit 110 and the dust receptacle 120 when desired and helps separation of the cyclone unit 110 from the dust receptacle 120 when removing the dust collected in the dust receptacle 120. The dust receptacle fixing/separating apparatus 200 comprises a fixing/separating handle 210, a locking/unlocking part 220, and a fixing part 230 (FIG. 5).

Figure 3:
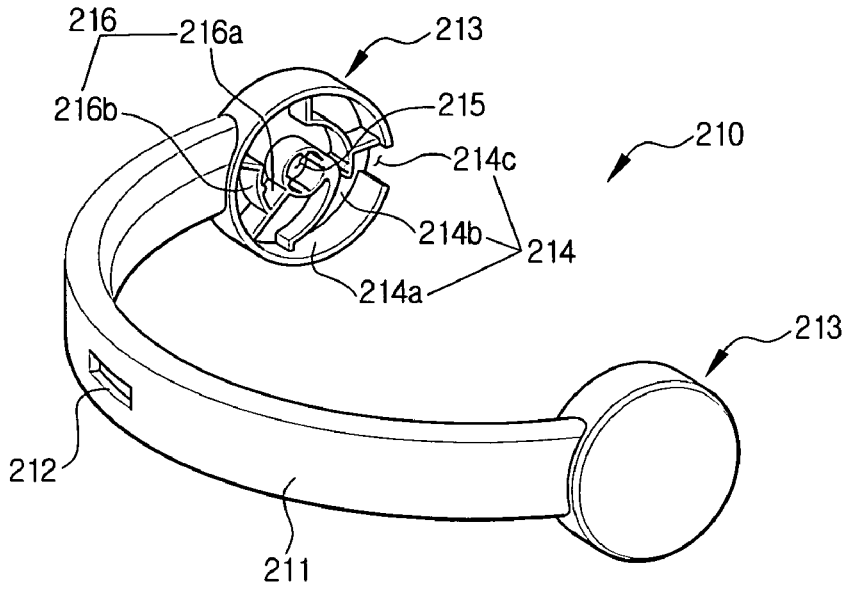
FIG. 3 is a perspective view of a fixing/separating handle of the dust receptacle fixing/separating apparatus of FIG. 2A.

Referring to FIG. 3, the fixing/separating handle 210 comprises a handle part 211 for a user to grasp, and a hinge connection part 213 formed on opposite ends of the handle part 211. The fixing/separating handle 210 is mounted to pivot between a first position (FIG. 2A) and a second position (FIG. 2B). In the first position, connection between the cyclone unit 110 and the dust receptacle 120 is fixed and in the second position, the connection is released. The fixing/separating handle 210 is locked in the first position by the locking/unlocking part 220, thereby tightly fixing the cyclone unit 110 to the dust receptacle 120. When the fixing/separating handle 210 is in the second position, the cyclone unit 110 can be separated from the dust receptacle 120. The first position is substantially perpendicular to the second position.

A locking groove 212 is formed at the center of the handle part 211. The locking groove 212 is engaged with a locking projection 222 (FIG. 4) of the locking/unlocking part 220 when the fixing/separating handle 210 is in the first position. The hinge connection part 213 comprises an outer frame 214 having a tubular form of which one side is open, a hinge connection groove 215 formed at the center of the outer frame 214, and fixing ribs 216 radially arranged around the hinge connection groove 215.

Figure 7:
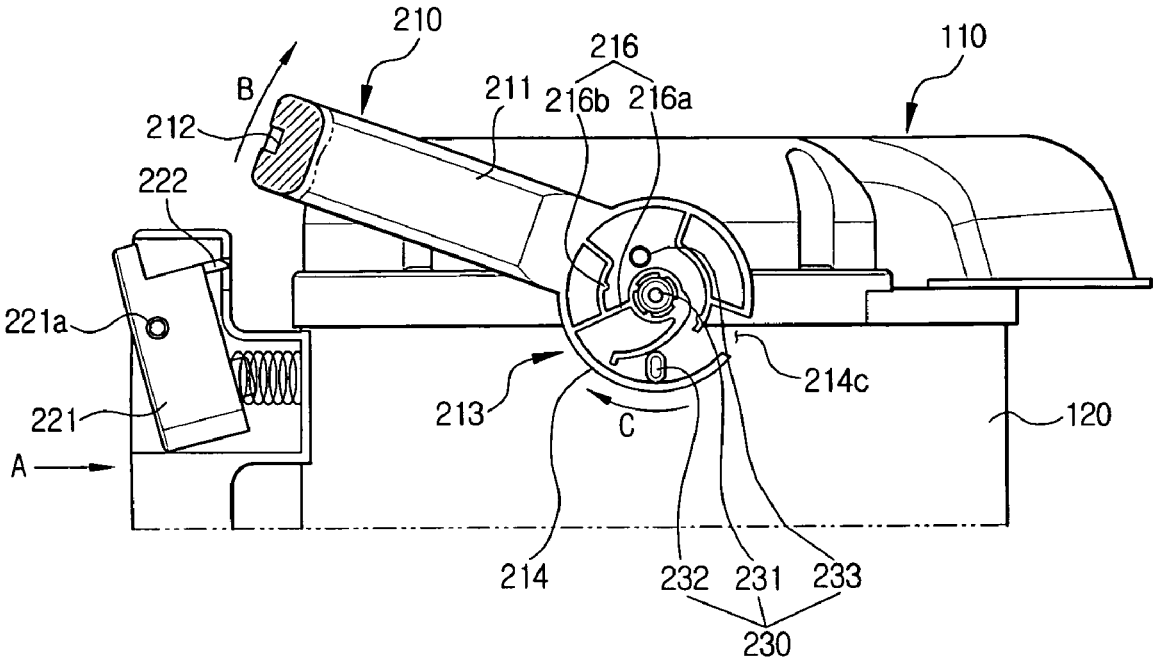
FIGS. 7 and 8 are views for explaining the operation of the dust receptacle fixing/separating apparatus according to an embodiment of the present invention.
Figure 8:
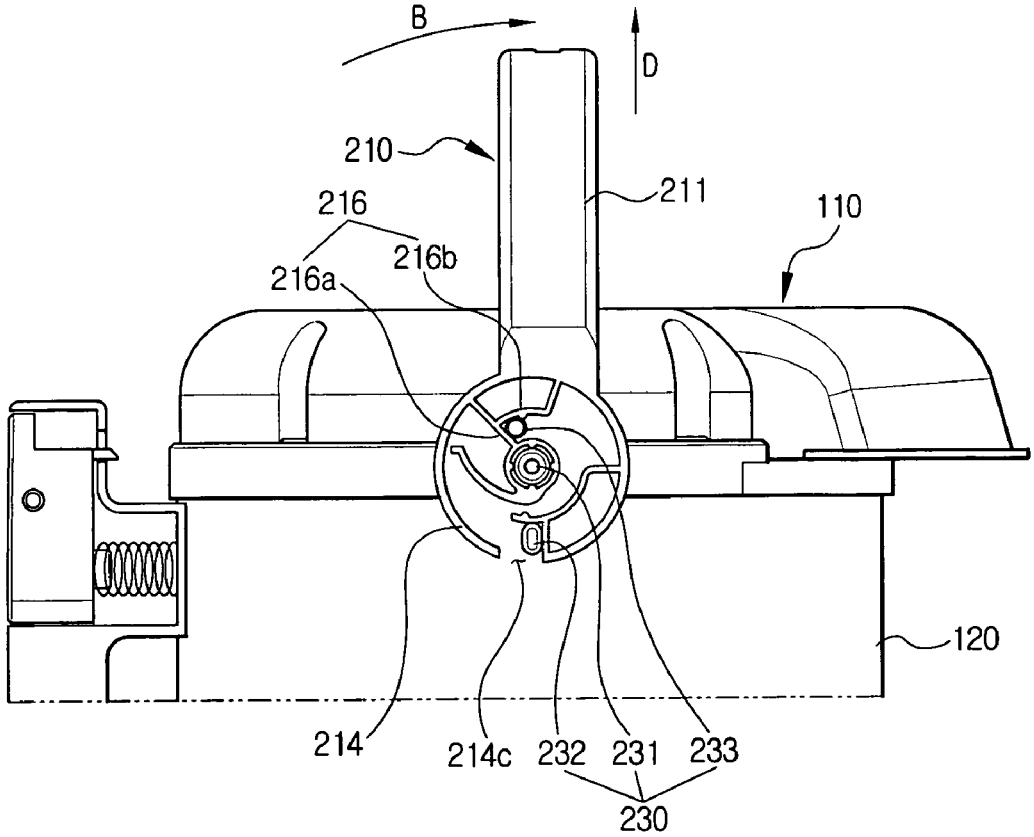

The outer frame 214 comprises a bottom part 214*b* where the hinge connection groove 215 and the fixing rib 216 are mounted, and a side part 214*a* protruded from an outer circumference of the bottom part 214*b* by a predetermined height and connected to the handle part 211 by an outer surface thereof. The side part 214*a* has a separation opening 214*c* at a predetermined portion. When the fixing/separating handle 210 is in the second position, the separation opening 214*c* is located corresponding to a first projection 232 of the fixing part 230, as shown in FIG. 8. The hinge connection groove 215 is engaged with a hinge shaft 231 (FIG. 5) of the fixing part 230 so that the fixing/separating handle 210 can pivot with respect to the hinge shaft 231. The fixing rib 216 comprises a first rib 216*a* and a second rib 216*b*. While the fixing/separating handle 210 is converting from the first position to the second position, the second rib 216*b* is brought into contact with an outer circumference of the second projection 233, as shown in FIG. 7. When the fixing/separating handle 210 reaches the second position, the first rib 216*a* is restricted by the second projection 233. Therefore, the fixing/separating handle 210 cannot pivot in an arrowed direction B any more (See FIG. 8).

Figure 4:
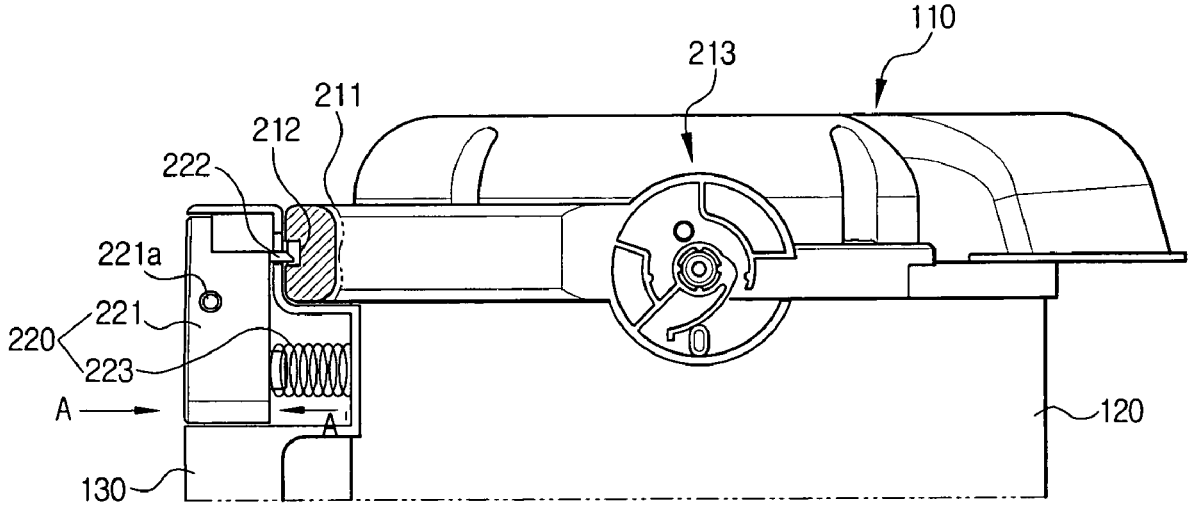
FIG. 4 is a sectional view of a locking/unlocking part of the dust receptacle fixing/separating apparatus of FIG. 2A.

Referring to FIG. 4, the locking/unlocking part 220 is disposed at an upper portion of the receptacle handle 130 of the dust receptacle 120 and comprises a button 221 and a resilient member 223. As the fixing/separating handle 210 is in the first position, the locking projection 222 is engaged with the locking groove 212 formed at the fixing/separating handle 210. The resilient member 223 is connected to the button 221 by one end and to an inside of the receptacle handle 130 by the other end to resiliently bias the button 221 in an arrowed direction A'. When a lower portion of the button 221 is pressed in the direction A, the button 221 is rotated about a rotation shaft 221*a* and the locking projection 222 is released from the locking groove 212.

The locking/unlocking part 220 of this embodiment is mounted to the receptacle handle 130. Although the present invention is not limited so, for example, although the locking/unlocking part 220 can be directly mounted to the dust receptacle 120, it is preferable to provide the locking/unlocking part 220 to the upper portion of the receptacle handle 130 so that the user can easily operate the button 221, while holding the receptacle handle 130 with one hand, using his/her thumb.

Referring to FIG. 5, the fixing part 230 comprises the hinge shaft 231, a first projection 232, and the second projection 233. According to the present embodiment, the hinge shaft 231 and the second projection 233 are preferably installed to the cyclone unit 110, and the first projection 232 to the dust receptacle 120.

Figure 6:
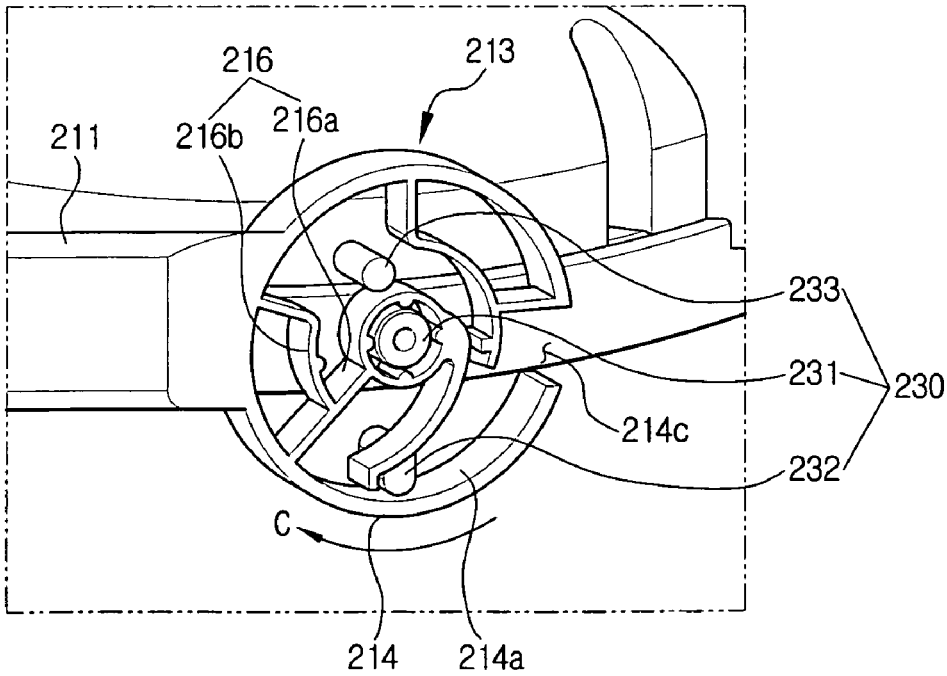
FIG. 6 is an inner-perspective view showing the fixing/separating handle and the fixing part of FIG. 2 as engaged with each other.

FIG. 6 shows the hinge connection part 213 of the fixing/separating handle 210 being engaged with the fixing part 230 when the fixing/separating handle 210 is in the first position. For concise explanation, the bottom part 214*b* (FIG. 3) of the outer frame 214 is omitted in FIG. 6. As aforementioned, the hinge shaft 231 is inserted in the hinge connection groove 215 (FIG. 3) so that the fixing/separating handle 210 can pivot with respect to the hinge shaft 231.

An inner circumference of the side part 214*a* of the outer frame 214 contacts with the first projection 232. When the hinge connection part 213 rotates about the rotation shaft 231 in an arrowed direction C, the side part 214*a* of the outer frame 214 is rotated in contact with the outer circumference of the first projection 232. As illustrated, since the first projection 232 formed at the dust receptacle 120 is restricted by the outer frame 214, connection between the dust receptacle 120 and the cyclone unit 110 is maintained.

As described above, as the fixing/separating handle 210 is moved to the second position, the hinge connection part 213 is further rotated in the direction C and accordingly, the separation opening 214*c* of the outer frame 214 is located to correspond to the first projection 232 of the fixing part 230, as shown in FIG. 8. Since the outer frame 214 can liberally move up and down in an arrowed direction D without restriction by the first projection 232, the cyclone unit 110 and the dust receptacle 120 can be separated from each other by lifting the handle part 211. In addition, by the rotation of the hinge connection part 213 as the fixing/separating handle 210 moves to the second position, the first rib 216*a* of the fixing rib 216 is brought into contact with the second projection 233 of the fixing part 230. As a result, the fixing/separating handle 210 cannot pivot in the direction B any more (See FIG. 8).

Hereinbelow, the operations of the dust receptacle fixing/separating apparatus and the cyclone dust collecting device having the same according to an embodiment of the present invention will be described with reference to FIGS. 7 and 8.

When removing dust collected in the dust receptacle 120 after the cleaning work, the user grasps the receptacle handle 130 of the dust receptacle 120 and separates the cyclone dust collecting device 100 from the cleaner body 20 (FIG. 1). At this time, the fixing/separating handle 210 is in the first position, being fixed by the locking/unlocking part 220, and the cyclone unit 110 and the dust receptacle 120 are firmly connectioned with each other, as shown in FIG. 2A.

Referring to FIG. 7, in a state that, the fixing/separating handle 210 is in the first position, when the button 221 is pressed in the direction A, the button 221 is rotated about the rotation shaft 221*a*, accordingly releasing the engagement between the locking projection 222 and the locking groove 212. The user grasps with one hand and rotates in the direction B the handle part 211 of the fixing/separating handle 210 which is released. By rotation of the handle part 211, the hinge connection part 213 is rotated in the direction C with respect to the hinge shaft 231. Meanwhile, since the outer frame 214 is kept in contact with the first projection 232 of the fixing part 230, connection between the cyclone unit 110 and the dust receptacle 120 is maintained.

Referring to FIG. 8, when the fixing/separating handle 210 moves in the direction B up to the second position, the first rib 216*a* of the fixing rib 216 is restricted by the second projection 233 of the fixing part 230. Accordingly, the handle part 211 cannot keep rotation in the direction B any more.

Meanwhile, since the separation opening 214*c* of the outer frame 214 is located corresponding to the first projection 232 of the fixing part 230, as the handle part 211 is lifted in the direction D, the outer frame 214 escapes from the first projection 232 through the separation opening 214*c*. Accordingly, the cyclone unit 110 and the dust receptacle 120 are separated from each other as shown in FIG. 2B. After thus separating the cyclone unit 110 from the dust receptacle, the user is able to remove the dust collected in the dust receptacle 120.

To summarize, the user grasps the receptacle handle 130 formed at the dust receptacle 120 and presses the button 221 to release connection between the cyclone unit 110 and the dust receptacle 120. Then, by moving the handle part 211 of the fixing/separating handle 210 to a predetermined position and lifting the handle part 211, the user can separate the cyclone unit 110 and the dust receptacle 120 from each other. In other words, the cyclone unit 110 and the dust receptacle 120 can be separated from each other through a simple operation, thereby facilitating removal of the collected dust. Moreover, except when separating the dust receptacle 120 from the cyclone unit 110 on purpose to empty the dust receptacle 120, connection between the cyclone unit 110 and the dust receptacle 120 can be firmly maintained. Therefore, unexpected separation of the dust receptacle 120 from the cyclone unit 110 will not easily happen while carrying or operating the cyclone dust collecting device 100, thereby preventing contamination of the surroundings by the dust scattered about from the dust receptacle 120.

As can be appreciated from the above description of the dust receptacle fixing/separating apparatus 200 and the cyclone dust collecting device 100 having the same, according to an embodiment of the present invention, the user is able to separate the dust receptacle 120 from cyclone unit 110 and remove the collected dust conveniently. In addition, since connection between the dust receptacle 120 and the cyclone unit 110 is secured, unexpected separation of the dust receptacle 120 from the cyclone unit 110 can be prevented.

While the invention has been shown and described with reference to certain embodiments thereof, it will be understood by those skilled in the art that various changes in form and details may be made therein without departing from the spirit and scope of the invention as defined by the appended claims.

What is claimed is:

1. A dust receptacle fixing/separating apparatus that fixes and separates a dust receptacle with respect to a cyclone unit, comprising:

a fixing/separating handle pivoting between a first position and a second position, the first position in which the cyclone unit and the dust receptacle are fixed to each other and the second position in which the cyclone unit and the dust receptacle can be separated from each other;

a locking/unlocking part fixing and releasing the fixing/separating handle when the fixing/separating handle is in the first position; and a fixing part to which the fixing/separating handle is pivotably connected, the fixing part releasing connection between the cyclone unit and the dust receptacle when the fixing/separating handle is in the second position, wherein the fixing/separating handle comprises:

a handle part having a locking groove for engagement with a locking proiection formed at the locking/unlocking part; and a hinge connection part formed on opposite ends of the handle part and engaged with a hinge shaft of the fixing part, wherein the locking/unlocking part comprises:

a button including the locking projection; and a resilient member connected to the button by one end to resiliently bias the button in one direction, and wherein the locking/unlocking part is provided to a receptacle handle formed on the dust receptacle.

2. The dust receptacle fixing/separating apparatus of claim 1, wherein the fixing part includes a first projection formed in adjacent to the hinge shaft, and the hinge connection part comprises an outer frame pivoting in contact with the first projection by an inner circumference thereof and having a separation opening at a predetermined portion, and a hinge connection groove formed at the center of the outer frame and engaged with the hinge shaft, the separation opening being located to correspond to the first projection as the fixing/separating handle is in the second position.

3. The dust receptacle fixing/separating apparatus of claim 2, wherein the hinge shaft is mounted to the cyclone unit while the first projection is mounted to the dust receptacle.

4. The dust receptacle fixing/separating apparatus of claim 3, wherein the fixing part further comprises a second projection mounted to the dust receptacle to be located within the outer frame, and the hinge connection part further comprises a fixing rib mounted inside the outer frame, the fixing rib contacting with the second projection as the fixing/separating handle is moved to the second position, thereby restraining the fixing/separating handle from pivoting any more in a direction to the second position.

5. The dust receptacle fixing/separating apparatus of claim 1, wherein the first position and the second position are substantially perpendicular to each other.

6. A cyclone dust collecting device including a dust receptacle having a receptacle handle and opened upward, and a cyclone unit removably connected to the dust receptacle and centrifugally separating dust from external air, the cyclone dust collecting device comprising:

a fixing/separating handle pivoting between a first position and a second position, the first position in which the cyclone unit and the dust receptacle are fixed to each other and the second position in which the cyclone unit and the dust receptacle can be separated from each other;

a locking/unlocking part mounted to the receptacle handle to fix and release the fixing/separating handle when the fixing/separating handle is in the first position; and a fixing part to which the fixing/separating handle is pivotably connected, releasing connection between the cyclone unit and the dust receptacle when the fixing/separating handle is in the second position.

7. The cyclone dust collecting device of claim 6, wherein the fixing/separating handle comprises:

a handle part having a locking groove for engagement with a locking projection formed at the locking/unlocking part; and a hinge connection part formed on opposite ends of the handle part and engaged with hinge shaft of the fixing part.

8. The cyclone dust collecting device of claim 7, wherein the locking/unlocking part comprises:

a button including the locking projection; and a resilient member connected to the button by one end and to the receptacle handle by the other end so as to resiliently bias the button in one direction.

9. The cyclone dust collecting device of claim 8, wherein the fixing part comprises a hinge shaft mounted to the cyclone unit and a first projection mounted to the dust receptacle, and the hinge connection part comprises an outer frame pivoting in contact with the first projection by an inner circumference thereof and having a separation opening at a predetermined portion, and a hinge connection groove formed at the center of the outer frame and engaged with the hinge shaft, the separation opening being located to correspond to the first projection as the fixing/separating handle is in the second position.

10. The cyclone dust collecting device of claim 9, wherein the fixing part further comprises a second projection mounted to the dust receptacle to be located within the outer frame, and the hinge connection part further comprises a fixing rib mounted inside the outer frame, the fixing rib contacting with the second projection as the fixing/separating handle is moved to the second position, thereby restraining the fixing/separating handle from pivoting any more in a direction to the second position.

* * * * *